United States Patent [19]

Johnson

[11] Patent Number: 4,495,132

[45] Date of Patent: Jan. 22, 1985

[54] METHOD AND APPARATUS FOR MAKING ANTIQUE BRICK

[75] Inventor: Joseph A. Johnson, Malakoff, Tex.

[73] Assignee: Texas Industries, Inc., Dallas, Tex.

[21] Appl. No.: 422,136

[22] Filed: Sep. 23, 1982

[51] Int. Cl.[3] ..... B28B 11/08

[52] U.S. Cl. ..... 264/293; 198/410; 198/411; 198/416; 264/133; 264/148; 264/DIG. 66; 425/297; 425/304; 425/305.1; 425/385; 425/403.1; 425/DIG. 108

[58] Field of Search ..... 264/293, 132, 133, 148, 264/DIG. 66; 425/385, 112, 305.1, 304, 297, 403.1, 444, DIG. 108; 198/410, 411, 416

[56] References Cited

U.S. PATENT DOCUMENTS

| | | | |
|---|---|---|---|
| 1,179,383 | 4/1916 | Adderson | 198/416 X |
| 1,233,261 | 7/1917 | Munn | 198/434 |
| 1,735,497 | 11/1929 | Duty | 264/162 |
| 1,845,383 | 2/1932 | Wyatt | 264/293 |
| 2,667,959 | 2/1954 | Rogers | 198/416 |
| 3,085,671 | 4/1963 | Pixley | 198/20 |
| 3,085,696 | 4/1963 | Stainforth et al. | 214/6 |
| 3,508,640 | 4/1970 | DeGood et al. | 198/412 |
| 3,592,326 | 7/1971 | Zimmerle | 198/33 R |
| 3,771,932 | 11/1973 | Van Daal | 425/385 X |
| 4,086,744 | 5/1978 | Seragnoli | 198/416 |
| 4,147,491 | 4/1979 | Postell, Jr. | 425/385 |
| 4,225,031 | 9/1980 | Frisbie et al. | 198/410 X |

FOREIGN PATENT DOCUMENTS

| | | | |
|---|---|---|---|
| 1283151 | 11/1968 | Fed. Rep. of Germany | 198/416 |

*Primary Examiner*—Jay H. Woo
*Assistant Examiner*—James C. Housel
*Attorney, Agent, or Firm*—Richards, Harris & Medlock

[57] ABSTRACT

An apparatus for treating the edges of pre-fired brick includes an extruder for extruding a column of clay and a wire cutter assembly for severing the column into individual bricks having their longitudinal axes substantially perpendicular to the direction of extrusion. The bricks are transported to a first conveyor where they are turned and directed to a side conveyor. As the pre-fired bricks move on the side conveyor, they move in a single file arrangement with their longitudinal axes substantially parallel to the direction of movement. The upper longitudinal edges of the pre-fired brick are treated by engagement with a pair of canted rollers to give the edges of the brick an irregular appearance. The bricks are then reoriented by a pair of rotating tables which direct the bricks onto a third conveyor with the axes of the brick being substantially perpendicular to their direction of travel.

20 Claims, 4 Drawing Figures

METHOD AND APPARATUS FOR MAKING ANTIQUE BRICK

TECHNICAL FIELD

The present invention relates to a method and apparatus for making antique brick and more specifically to a method and apparatus for treating the longitudinal edges of the brick face to simulate an antique appearance.

BACKGROUND ART

The use of old brick which has been reclaimed from turn-of-the-century or older structures has become very popular in construction of new buildings, and particularly in residential construction. This brick, referred to as antique brick, is significantly more expensive than new brick because of the labor involved in reclaiming and cleaning the brick. Antique brick has a unique appearance in that many of the bricks have random deformations and chips from the surfaces and edges. Because of the popularity of antique brick, some manufacturers have attempted to produce a new brick having the appearance of antique brick. Production of such brick includes deforming the face of the brick, as well as applying various color combinations to the face of the brick to simulate the antique appearance.

Because of the method of making brick, it has been very difficult in the past to treat the longitudinal edges of the brick to simulate antique brick. In one primary method of making clay brick, a column of clay is extruded and the brick is cut such that its longitudinal axis is perpendicular to the direction of travel of the extrusion. In this way, bricks are produced in a very close side-by-side arrangement. This has made the treatment of the longitudinal edges of the brick very difficult.

In one prior art method of treating the longitudinal edges, the bricks are placed in spaced rows and a roller is moved along each of the rows contacting the longitudinal edges of the brick to deform the brick. In an alternative method, a plurality of bricks is aligned side-by-side and moved simultaneously along their longitudinal axes under rollers which are aligned to engage the longitudinal edges of the bricks. Because these methods require the positioning of the bricks in particular rows and the movement of a roller or pair of rollers along each row of bricks, or the movement of a limited number of aligned bricks past a plurality of stationary rollers, the methods are inefficient and do not lend themselves to satisfactory high production output. Further, these prior art methods produce brick having repeated patterns of deformation and, thus, the bricks do not have an authentic antique appearance.

DISCLOSURE OF THE INVENTION

The present invention provides a method and apparatus for treating the longitudinal edges of prefired brick in such a way as to permit high production runs. Further, the present invention treats the longitudinal edges of the brick face and properly orients the brick for later movement on a conveyor for removal and loading for subsequent firing of the brick.

The apparatus of the present invention includes structure for extruding a column of clay and a wire cutter for severing the column into individual bricks having their longitudinal axes substantially perpendicular to the direction of extrusion. The bricks are transported to a first conveyor where they are turned and directed to a side conveyor by a diverter gate. As the pre-fired bricks move on the side conveyor, they move in single file with their longitudinal axes substantially parallel to the direction of movement.

The upper longitudinal edges of the pre-fired brick are treated by engagement with a pair of canted rollers which deform the edges to give an irregular appearance. The bricks are then reoriented by a pair of rotating tables which direct the bricks onto the first conveyor with the axes of the bricks being substantially perpendicular to their direction of travel. The bricks are then moved to an area where they are removed from the conveyor and loaded onto carts for movement into the kiln. Because of the positioning of the bricks on the conveyor, as well as the spacing provided between the bricks by the present invention, the bricks may be readily removed and stacked for later firing. Upon firing of the brick, the deformed longitudinal edges of the brick face give the appearance of antique brick.

In a more specific embodiment of the invention, the bricks are first turned as a result of the engagement of one end of the brick by the first conveyor before the engagement of the opposite end. Thus, the brick is turned and then aligned by engagement with a diverter gate positioned over the first conveyor and in the path of the bricks. The diverter gate directs the bricks onto the side conveyor.

The reorienting of the bricks subsequent to the treatment of the longitudinal edges of the face of the brick is accomplished in the preferred embodiments by using a first rotary table which receives the bricks thereon and rotates to change the orientation of the longitudinal axes of the bricks. A second rotary table, rotating opposite the first rotary table, then receives the bricks and deposits the bricks onto the first conveyor. The bricks, when deposited onto the first conveyor, are positioned such that their longitudinal axes are substantially perpendicular to the direction of travel of the conveyor.

The method of the present invention for treating the longitudinal edges of pre-fired brick includes transporting the brick along a conveyor with the longitudinal axes substantially perpendicular to the direction of travel of the brick and turning the bricks such that the longitudinal edges are substantially parallel to the direction of travel of the bricks. The longitudinal edges of the bricks are treated and the bricks are then reoriented and deposited onto the conveyor such that the treated edges are substantially perpendicular to the direction of travel of the conveyor and the bricks.

BRIEF DESCRIPTION OF THE DRAWINGS

For a more complete understanding of the present invention, and for further details and advantages thereof, reference is now made to the following Detailed Description taken in conjunction with the accompanying Drawings, in which.

DETAILED DESCRIPTION

Figure 1:
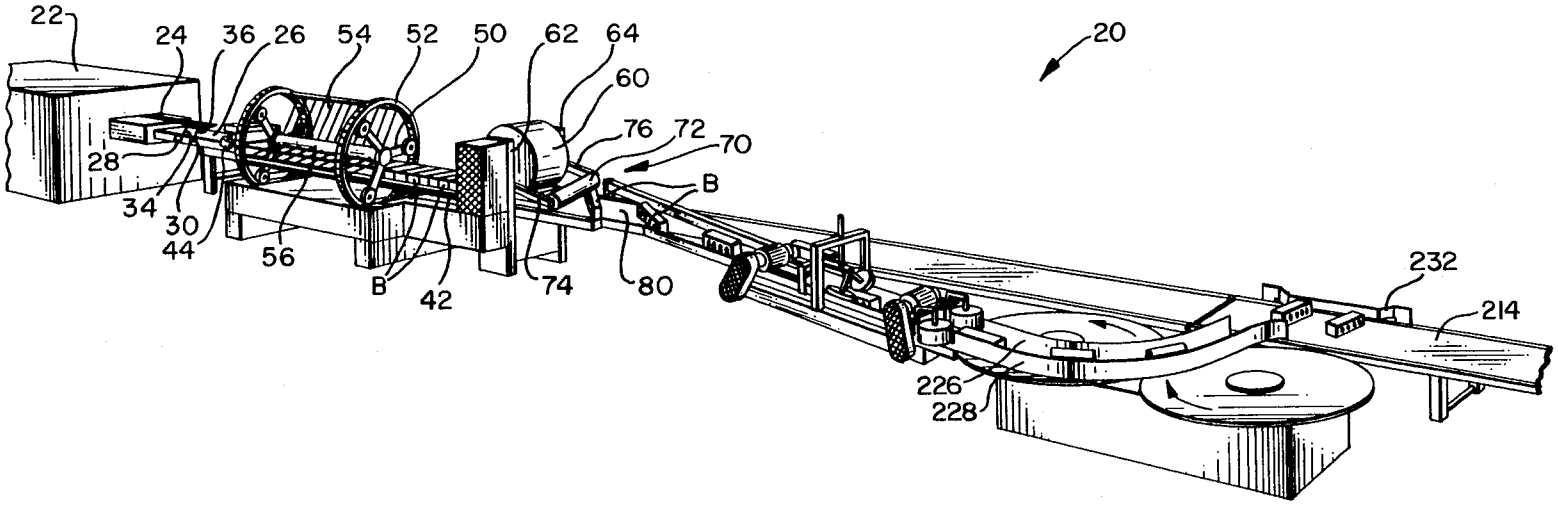
FIG. 1 is a perspective view showing the present apparatus for making antique brick.
Figure 2:
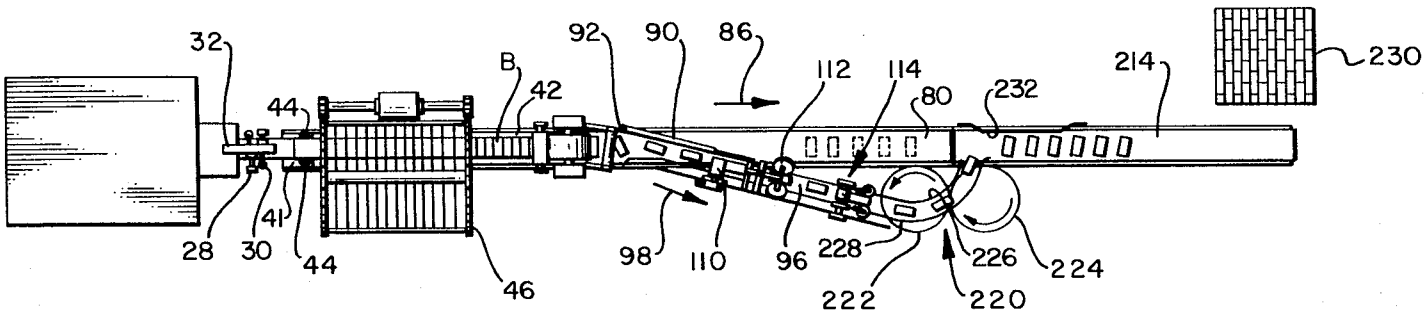
FIG. 2 is a top plan view thereof.

FIGS. 1 and 2 illustrate a perspective and plan view, respectively, of the overall system of the present invention for forming and antiqueing brick. The apparatus 20 includes an extruder 22 having a die 24 through which a column of brick clay 26 is extruded. A plurality of cutting blades 28 and 30 is positioned from an overextending platform 32 by way of arms 34 and 36. Arms 34 and 36, and thus knife blades 28 and 30, are operated to move inwardly against extruded column 26 in a controlled fashion such that pieces of the extrusion are cut away in a somewhat random fashion from the column to simulate chips and breaks in the edge of the end face of the brick as will be seen hereinafter in greater detail.

Extruded column 26 moves on a transport conveyor 41 below a pair of canted edge deformation rollers which deform the upper longitudinal edge of the extruded column. A rotating cutter assembly 46 is used to cut column 26 into individual bricks. Cutter assembly 46 includes a stationary frame 50 and a rotating frame 52 having four sets of wires 54 extending radially outwardly from central shaft 56. The rotation of frame 52 causes wires 54 to pass through extruded column 26 and thereby sever the column to form individual bricks B as is well known in the art. The severed brick then continue to move over a transport sliding plate 42 below a rotating drum 60 which is supported above the conveyor by channels 62 and 64. Drum 60 has a plurality of irregular protrusions extending from the surface thereof for engaging and deforming the face of the brick. Drum 60 may be raised so as not to engage the bricks if these deformations are not desired on a particular design.

Figure 3:
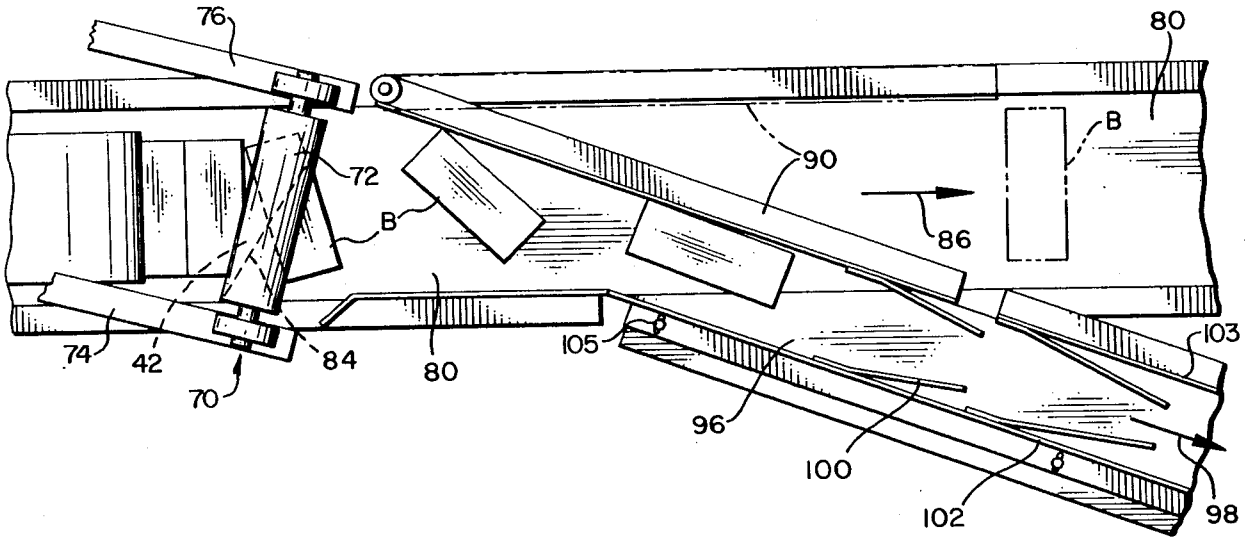
FIG. 3 is an enlarged top plan view of the portion of the apparatus used to turn and divert the pre-fired brick for treatment of the longitudinal edges of the brick face.

The bricks continue to move on transport slide plate 42 below a floating roller assembly 70. Roller assembly 70 includes a roller 72 supported by arms 74 and 76. Bricks B move below and are engaged by roller 72 which acts to separate the bricks as they contact first conveyor 80. First conveyor 80 moves in the direction illustrated by arrow 86. As can be seen in FIG. 3, the end of slide plate 42 overlies first conveyor 80 such that its forward facing edge 84 is at an angle to the direction of travel of the conveyor. As is best seen in FIG. 3, as bricks B pass over plate 42 and onto conveyor 80, one end of the brick engages conveyor 80 before the opposite end of the brick. Thus, the bricks are turned on conveyor 80 as is shown.

As the bricks move with conveyor 80, they engage a movable gate 90 and slide forward against the gate. Gate 90 is positioned slightly above conveyor 80 and is pivotable upon a shaft 92. With gate 90 in the position shown in FIGS. 1, 2 and 3, bricks B are directed to a second conveyor 96 having an upper surface moving in the direction illustrated by arrow 98 in FIGS. 2 and 3. The bricks are centered on conveyor 96 by spring steel plates 100 which extend outwardly from side walls 102 and 103 defining the path for the bricks along conveyor 96. Plates 100 may be moved inwardly or outwardly by adjusting side wall 102 using adjustment bolts 105. Each brick, moving in single file along conveyor 96, is moving with its longitudinal axis substantially parallel to the direction of travel of the conveyor. The bricks move below and are engaged by a face engaging roller assembly 110, edge treating assembly 112 and a second face engaging and side engaging roller assembly 114. These three assemblies are more clearly illustrated in FIG. 4.

Figure 4:
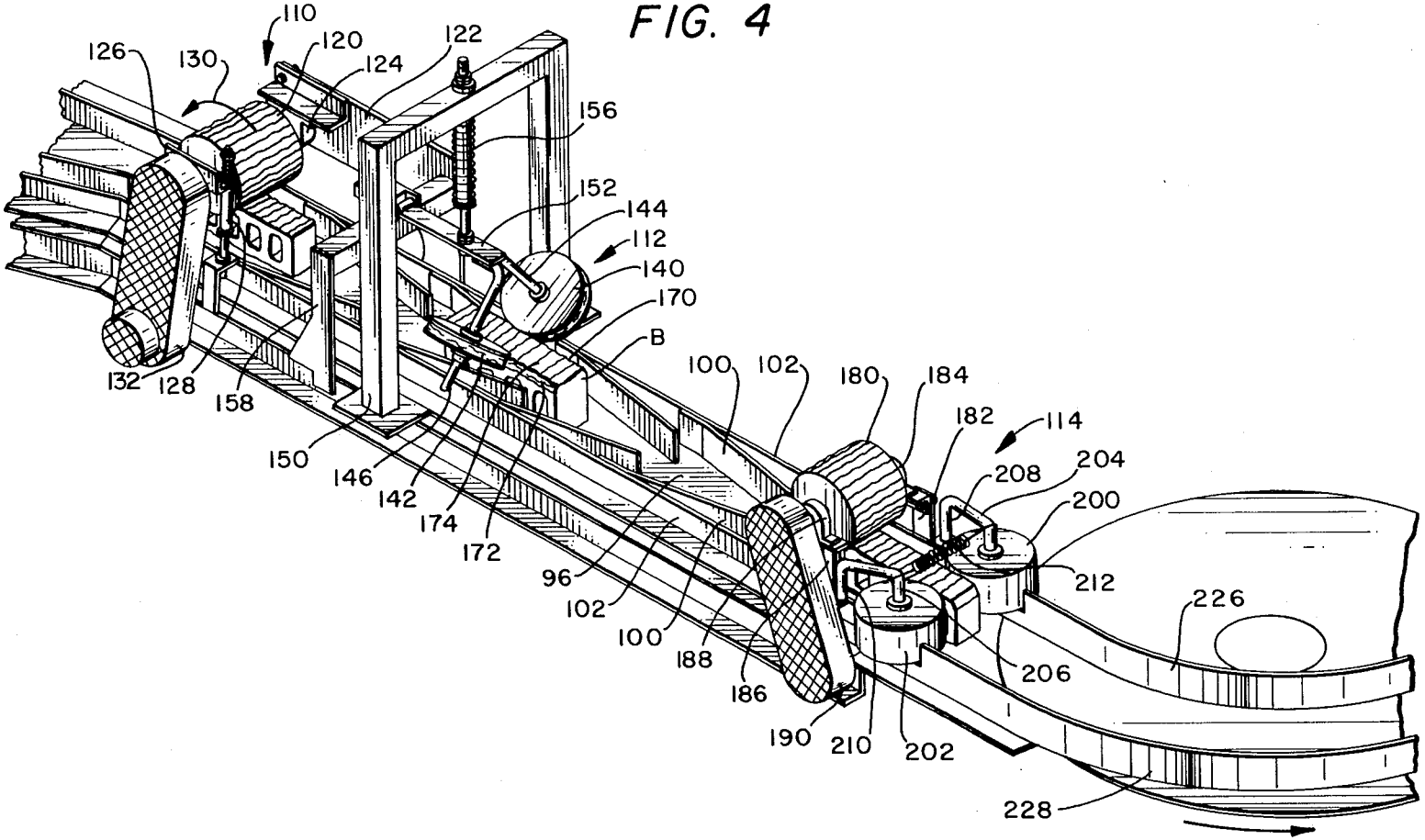
FIG. 4 is a perspective view showing a typical apparatus for treating the longitudinal edges of the brick face.

Referring to FIG. 4, face engaging roller assembly 110 includes a roller 120 rotatable on a horizontal axis supported on one side by an arm 122 and appropriate bearing assembly 124 and on the opposite side by an arm and drive mechanism 126. An adjustment structure 128 is also provided for varying the vertical position of the roller. The rotation of roller 120 is in the direction illustrated by arrow 130 and thus cooperates with conveyor 96 for moving the bricks forwardly to the edge treating assembly 112. A shaft through roller 120 is driven by an appropriate belt enclosed in guard 132 by way of a driven sheave mounted on an extension of the tail pulley of the conveyor drive system for conveyor 96.

Assembly 112 includes a pair of disc rollers 140 and 142 supported on shafts 144 and 146, respectively, and supported from a horseshoe frame 150 by a pivoting arm 152 which is biased downwardly by a spring and shaft assembly 156. Arm 152 is pivoted from a subframe 158 which controls the limit of deflection of assembly 112. As can be seen in FIG. 4, as bricks B move on conveyor 96, the longitudinal edges 170 and 172 of the face 174 of each brick is engaged by rollers 140 and 142. The rollers are canted such that they are aligned at an angle to the plane of the brick. The rollers have irregular circumferential outer edges and thus, impart an irregular deformation on the edges of the pre-fired brick.

Referring still to FIG. 4, as the bricks move further on conveyor 96, they are centered by the aligning plates 100 which are attached along wall 102 mounted above conveyor 96. Bricks B pass below a second face engaging and side engaging roller assembly 114. Assembly 114 includes a face engaging deformation roller 180 rotatable on a horizontal shaft supported on one side by an upstanding bracket 182 and an appropriate bearing assembly 184. On the near side, roller 180 is supported by a bracket assembly 186 and a bearing 188. A shaft through roller 180 is driven by an appropriate belt enclosed in guard 190 by way of a driven sheave mounted on an extension of the head pulley of the conveyor drive system for conveyor 96. Assembly 114 also includes a pair of side rollers 200 and 202 supported on pivoting arms 204 and 206, respectively. Arms 204 and 206 each have a leg 208 and 210, respectively, which is pivotally mounted to appropriate structure adjacent conveyor 96. A tension spring 212 is attached between arms 204 and 206 and biases rollers 200 and 202 inwardly against the sides of bricks B as they move therebetween. Rollers 200 and 202 remove objectionable burrs caused by the deformation of rollers 120, 140, 142 or 180.

Referring now to FIGS. 1, 2 and 4, with the longitudinal edges of the face of the brick having now been treated, the bricks are reoriented and positioned onto a third conveyor 214 with their longitudinal axes substantially perpendicular to the direction of travel of the conveyor by a rotary table assembly 220. Assembly 220 includes a first rotary table 222 which rotates in a counterclockwise direction and a second rotary table 224 rotating in a clockwise direction as seen in FIG. 2. Bricks B move from conveyor 96 onto rotary table 222 at an appropriate distance spaced from the center of the rotary table. The bricks follow the path defined by arcuate upstanding shields 226 and 228. As can best be seen in FIGS. 1 and 2, the bricks move along the path defined by upstanding shields 226 and 228 and move from rotary table 222 to rotary table 224. The rotation of rotary table 224 propels the bricks onto third conveyor 214. As can be seen in FIG. 1, conveyor 214 is aligned with conveyor 80. As will be described hereinafter in greater detail, the speeds of conveyors 80 and 214 are different in the preferred arrangement of the present invention. A back stop 232 prevents the bricks from passing off of conveyor 80. It will be appreciated that the bricks now are positioned such that their longitudinal axes are substantially perpendicular to the direction of travel of the conveyor on which they are carried. This greatly facilitates the withdrawal of the bricks from the conveyor and stacking of the bricks on carts 230. The pre-fired bricks are then moved on carts 230 to be fired in a kiln as is well known in the art. Because of the deformation mode in the prefired brick, the fired brick simulates antique brick.

In a preferred embodiment of the invention, the present invention is capable of a production of approximately 14,000 bricks per hour. No minimum production limit exists for the present design. To accomplish this production rate, the movement of brick on slide plate 42 is at a rate of 60 feet per minute while conveyor belts 80 and 96 are moved at approximately 395 feet per minute. Rotating tables 222 and 224 are moved at 58 revolutions per minute and have a diameter of approximately 36 inches with a working surface of approximately 32 inches. The working surface speed is approximately 485 feet per minute. The third conveyor 214 is moved at a rate of approximately 135 feet per minute. It will be appreciated that these rates are only given as examples of acceptable rates and may be varied upwardly or downwardly as is appropriate for a particular desired production rate.

From these figures, it is apparent that conveyor 80 must move at approximately four to five times the rate of movement of the brick on slide plate 42. This substantial increase in speed permits each brick to be moved from its position of having the longitudinal axis substantially perpendicular to its direction of travel to an orientation where its longitudinal axis is substantially parallel to the direction of travel, while maintaining the bricks in a single file arrangement with adequate spacing. Thus, the bricks are rotated approximately 90° and their speed substantially increased so that they may be each moved along a single path and engage an edge treating assembly for treating the longitudinal edges of the face of each brick. Subsequent to the edge treating process, the bricks are then reoriented and redirected to conveyor 214, in substantially the same orientation as originally extruded. Conveyor 214 is moving at a speed of approximately 135 feet per minute, that is, substantially slower than the speeds of conveyors 80 and 96. This permits removal of the bricks from conveyor 214 either by hand or machine, while providing an appropriate spacing between the bricks to facilitate their removal.

Referring to FIGS. 1, 2 and 3, it can be seen that the arrangement of the present brick production assembly permits complete bypass of the edge treating structure. Referring to FIG. 3, this is accomplished by retracting gate 90 to the position shown in phantom, and by reducing the speed of conveyor 80 to correspond to the speed of conveyor 214. It will also be beneficial to modify the end of slide plate 42 such that it is perpendicular to the direction of travel of conveyor 80. With these simple adjustments, bricks B are carried on conveyor 80 directly to the end of the conveyor system where the bricks are removed and stacked on an appropriate cart 230. In this arrangement, the bricks follow a straight path and have the orientation shown by the bricks in phantom in FIGS. 2 and 3. When treatment of the edges of the bricks is desired, the edge treatment feature is brought into play by merely pivoting gate 90 to the position which directs the pre-fired bricks through the edge treating structure as described hereinabove.

It will also be appreciated that gate 90 may be opened or may automatically open when a plurality of bricks become jammed in the area of the gate. Gate 90 may be held in the closed position by a magnet or other releasable structure which will automatically be disengaged when a sufficient force is applied corresponding to the jamming of a plurality of bricks at this location. In this way, the bricks may be carried by conveyors 80 and 214 to the end of the conveyor system where they may be discarded or recycled.

It may be now appreciated that the present invention provides a system for readily simulating antique brick including treating the longitudinal edges of the face of the brick to give the appearance of an antique brick. In the process of the invention, a column is extruded and severed into individual bricks having the longitudinal axes substantially perpendicular to the direction of extrusion. The bricks are transported to a first conveyor means where they are turned and directed to a side conveyor by a diverter gate. As the pre-fired bricks move on the side conveyor structure, they are carried in a single file arrangement with a longitudinal axis substantially parallel to the direction of movement. In this position, the upper longitudinal edges of the pre-fired brick are easily treated by engagement with a pair of canted rollers which deform the edges such that the fired brick will have an antique appearance. The bricks are then reoriented by tables which direct the bricks onto the first conveyor structure with the axes of the brick substantially perpendicular to the direction of travel of the conveyor. The bricks are moved to an area where they are moved from the conveyor and loaded onto carts for firing.

Thus, the present invention provides a method and apparatus which permits deforming pre-fired brick, both on the face of the brick as well as all edges of the brick face, to produce a brick which is almost indistinguishable from an antique brick. The method permits individual treatment of each brick while providing for high production speeds.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

I claim:

1. An apparatus for treating elongated products having longitudinal edges thereon comprising:

first transport means for transporting said products such that the longitudinal edges are substantially perpendicular to the direction of travel, first turning means for turning said products such that the longitudinal edges are substantially parallel to the direction of travel of the products and such that the products are moved in single file, said turning means including a first conveyor for receiving said product thereon, a second conveyor for receiving products thereon from said first conveyor and having an axis of movement divergent from that of said first conveyor, means for treating selected longitudinal edges of the products as the products are moved on said second conveyor, and second turning means for receiving said products from said second conveyor and for turning the products such that the longitudinal edges are substantially in the same orientation as said products on said first transport means and for depositing the products onto a third moving conveyor, said third conveyor moving slower than said first conveyor and in line with said first conveyor.

2. The apparatus according to claim 1 wherein said first turning means further comprises:

a shield positioned over said first conveyor such that one end of said elongated product engages said first conveyor before the end opposite said one end, thereby turning said products.

3. The apparatus according to claim 2 further comprising:

a diverter gate mounted over said first conveyor and in the path of said products for further turning of said products and directing said products onto a second conveyor means with said products moving with their longitudinal edges substantially parallel to the direction of travel.

4. The apparatus according to claim 2 wherein said first conveyor is moved at a speed such that said products are received thereon in single file.

5. The apparatus according to claim 3 wherein said second turning means comprises a first rotary table for receiving said products thereon from said second conveyor and rotating to turn said products such that the edges are in substantially the same orientation as the orientation of the edges of the products moving on said first transport means.

6. The apparatus according to claim 5 further comprising:

a second rotary table for receiving said products from said first rotary table and for directing said products onto said third conveyor, said second rotary table rotating in a direction to impart movement of said products in the direction of movement of said third conveyor.

7. An apparatus for treating selected longitudinal edges of uncured brick comprising:

first transport-conveyor means having a substantially straight line axis of movement for transporting a plurality of uncured brick along a first path with the longitudinal axes of said bricks substantially perpendicular to the direction of travel, means for turning said bricks onto a second conveyor means having a line of movement divergent from that of said first transport-conveyor means such that said bricks moves on said second conveyor means with their longitudinal axes substantially parallel to the direction of travel, means for treating the longitudinal edges of said bricks as said bricks move on said second conveyor means, and second means for turning said bricks subsequently to treating the edges thereof and redirecting said bricks onto said first transport-conveyor means with the longitudinal axes of the bricks substantially perpendicular to the direction of travel of said first transport-conveyor means.

8. The apparatus according to claim 7 wherein said first transport-conveyor means includes a first conveyor and a third conveyor in line with said first conveyor, said third conveyor aligned to receive bricks from said second turning means and said third conveyor moving at a speed substantially slower than said first conveyor.

9. The apparatus of claim 8 wherein said first turning means comprises a shield over said first conveyor which permits the engagement of one end of said bricks by said first conveyor before the engagement of the opposite end of said bricks by said first conveyor, thereby causing said bricks to turn, and a diverter gate mounted over said first conveyor and in the path of said bricks for directing said bricks onto said second conveyor means with the bricks moving with their longitudinal axes substantially parallel to the direction of travel of said second conveyor means.

10. The apparatus according to claim 7 wherein said treatment means comprises a pair of rollers for engagement with the bricks as the bricks are moved past said rollers on said second conveyor means.

11. The apparatus according to claim 10 wherein said rollers are canted to engage said longitudinal edges of the bricks.

12. The apparatus according to claim 7 wherein said second turning means comprises a first rotary table for receiving said bricks thereon and rotating to change the orientation of the longitudinal axes of the bricks such that the axis is substantially perpendicular to the direction of travel of said first transport-conveyor means and a second rotary table for receiving said bricks from the first rotary table and for directing said bricks onto said first transport-conveyor means.

13. An apparatus for treating a longitudinal edge of an elongated product having sides defining the longitudinal edge comprising:

a first transport means for transporting said product along a first direction of travel such that said edge is substantially perpendicular to the first direction of travel, first turning means for turning said product such that said edge is substantially parallel to the direction of travel of the product, said turning means including a first conveyor means for receiving said product thereon, a diverter means for diverting said product from said first conveyor means onto a second conveyor means with the product moving with said edge substantially parallel to the direction of travel of said product, means for treating said edge, and second turning means comprising a first rotary table for receiving said product thereon and rotating to turn said product such that said edge is substantially perpendicular to the direction of travel of said first conveyor means and a second rotary table for receiving said product from said first rotary table and for directing said product onto said first conveyor means, said second rotary table moving in a direction opposite that of the first rotary table to impart movement of said product in the direction of the first conveyor means.

14. The apparatus according to claim 13 wherein said first conveyor means comprises a first conveyor and a third conveyor in longitudinal alignment with said first conveyor, said third conveyor aligned to receive products from the second turning means and moving at a speed slower than said first conveyor.

15. The apparatus according to claim 13 wherein said diverter means includes a diverter gate mounted over said first conveyor means and in the path of said product for directing said product onto the second conveyor means.

16. The apparatus according to claim 15 wherein said first turning means comprises:

a shield positioned over said first conveyor means such that one end of said product engages said first conveyor means before the end opposite said one end thereby turning said product as said product contacts said first conveyor means.

17. The apparatus according to claim 13, wherein said treatment means comprises:

a second conveyor means for receiving said products from said first transport means after said products have been turned by said first turning means, and a pair of rollers for engaging said products as said products move past said rollers on said second conveyor means.

18. The apparatus according to claim 17 wherein said rollers are canted to engage the edge of said products.

19. The apparatus according to claim 18 wherein said edge is a longitudinal edge of the product.

20. A method of treating an elongated product having edges thereon comprising:

transporting said product along a first transport means with the edges substantially perpendicular to the direction of travel of the product, turning said product such that the edges are substantially parallel to the direction of travel of the products and transporting said product on a second conveyor having an axis divergent from that of said first conveyor, treating the edges of the products, moving said product to a first rotary table, rotating said product on said first rotary table to reorient said product such that the edges are substantially perpendicular to a moving third conveyor, and receiving said product from said first rotary table onto a second rotary table, said second rotary table rotating in a direction opposite the first rotary table to move said product onto said third conveyor and to impart a movement to said product in the direction of movement of the third conveyor.

* * * * *